US009834235B2

(12) United States Patent
Melas et al.

(10) Patent No.: US 9,834,235 B2
(45) Date of Patent: Dec. 5, 2017

(54) SYSTEM FOR REMOTELY OVERRIDING LOCOMOTIVE CONTROLS

(71) Applicant: Electro-Motive Diesel, Inc., LaGrange, IL (US)

(72) Inventors: Dennis Melas, Chicago, IL (US); Isaac Suwa Traylor, Brookfield, IL (US); Gregory Raymond Kupiec, Lemont, IL (US); Paul P. Jezior, Streamwood, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/526,239

(22) Filed: Oct. 28, 2014

(65) Prior Publication Data

US 2016/0114818 A1 Apr. 28, 2016

(51) Int. Cl.

| | |
|---|---|
| ***B61C 17/12*** | (2006.01) |
| ***B61L 15/00*** | (2006.01) |
| ***B61L 23/00*** | (2006.01) |
| ***B61L 27/00*** | (2006.01) |

(52) U.S. Cl.

CPC ..... *B61L 15/0072* (2013.01); *B61C 17/12* (2013.01); *B61L 15/0081* (2013.01); *B61L 23/00* (2013.01); *B61L 27/0094* (2013.01); *F02N 2200/023* (2013.01)

(58) Field of Classification Search

CPC .. B61L 15/0072; B61L 15/0081; B61L 23/00; B61L 27/0094; B61C 17/12; F02N 2200/023

See application file for complete search history.

(56) References Cited

U.S. PATENT DOCUMENTS

| | | | | |
|---|---|---|---|---|
| 2,915,644 | A | 1/1959 | Hillig | |
| 4,928,778 | A * | 5/1990 | Tin | G08C 25/02 123/179.3 |
| 6,170,452 | B1 | 1/2001 | Wisinski | |
| 6,351,703 | B1 * | 2/2002 | Avery, Jr. | B60R 25/04 123/179.2 |

(Continued)

FOREIGN PATENT DOCUMENTS

| | | |
|---|---|---|
| JP | S59168262 | 9/1984 |

OTHER PUBLICATIONS https://intellitrain.emdiesels.com/

*Primary Examiner* — Thomas G Black
*Assistant Examiner* — Peter D Dolan
(74) *Attorney, Agent, or Firm* — Finnegan, Henderson, Farabow, Garrett & Dunner, L.L.P.

(57) ABSTRACT

A control system is disclosed for use with a locomotive. The control system may have a component located onboard the locomotive, the component having a first state and a second state. The control system may also have an operator input device located onboard the locomotive and used to manually toggle operation of the component between the first and second states, and at least one sensor located onboard the locomotive and configured to generate a signal associated with a condition of the locomotive. The control system may also have an offboard controller located remotely from the locomotive and being configured to selectively override the operator input device and toggle operation of the component between the first and second states based on the signal.

8 Claims, 1 Drawing Sheet

(56) References Cited

U.S. PATENT DOCUMENTS 6,487,983 B1 * 12/2002 Jonsson ..... B63C 9/0011 114/144 R
6,941,218 B2 9/2005 Wolf et al.
7,171,300 B1 * 1/2007 Anderson ..... F02D 41/042 701/112
7,191,053 B2 * 3/2007 Dery ..... B60R 25/045 123/179.2
7,647,908 B1 1/2010 Biondo et al.
7,653,465 B1 * 1/2010 Geiger ..... B61L 3/127 701/19
7,760,108 B2 7/2010 McCall et al.
9,296,397 B2 * 3/2016 Morris ..... B61C 17/12
2002/0189564 A1 * 12/2002 Biess ..... F01M 5/021 123/142.5 R
2003/0055666 A1 3/2003 Roddy et al.
2004/0111199 A1 * 6/2004 Javaherian ..... F02N 11/0807 701/36
2004/0245410 A1 * 12/2004 Kisak ..... B61L 15/0027 246/3
2005/0010338 A1 * 1/2005 Kraeling ..... B61L 3/121 701/19
2006/0042590 A1 * 3/2006 Uplap ..... F02D 29/06 123/352
2008/0117079 A1 * 5/2008 Hassan ..... B60R 25/045 340/901
2010/0217406 A1 * 8/2010 Berry, Jr. ..... G05B 19/4188 700/3
2011/0093147 A1 * 4/2011 Kaltenbach ..... F02N 11/08 701/22
2013/0046421 A1 2/2013 El Fassi et al.
2014/0239127 A1 * 8/2014 Morris ..... B61C 17/12 246/182 B
2014/0277846 A1 * 9/2014 Melster ..... F02N 11/0807 701/2
2014/0371951 A1 * 12/2014 Michael ..... F02N 11/0807 701/2
2015/0116132 A1 * 4/2015 Nohra ..... H04Q 9/00 340/870.07
2015/0159615 A1 * 6/2015 Van Wiemeersch ..... F02N 11/0807 701/113
2015/0330318 A1 * 11/2015 Petersen ..... F02D 29/02 701/113

* cited by examiner

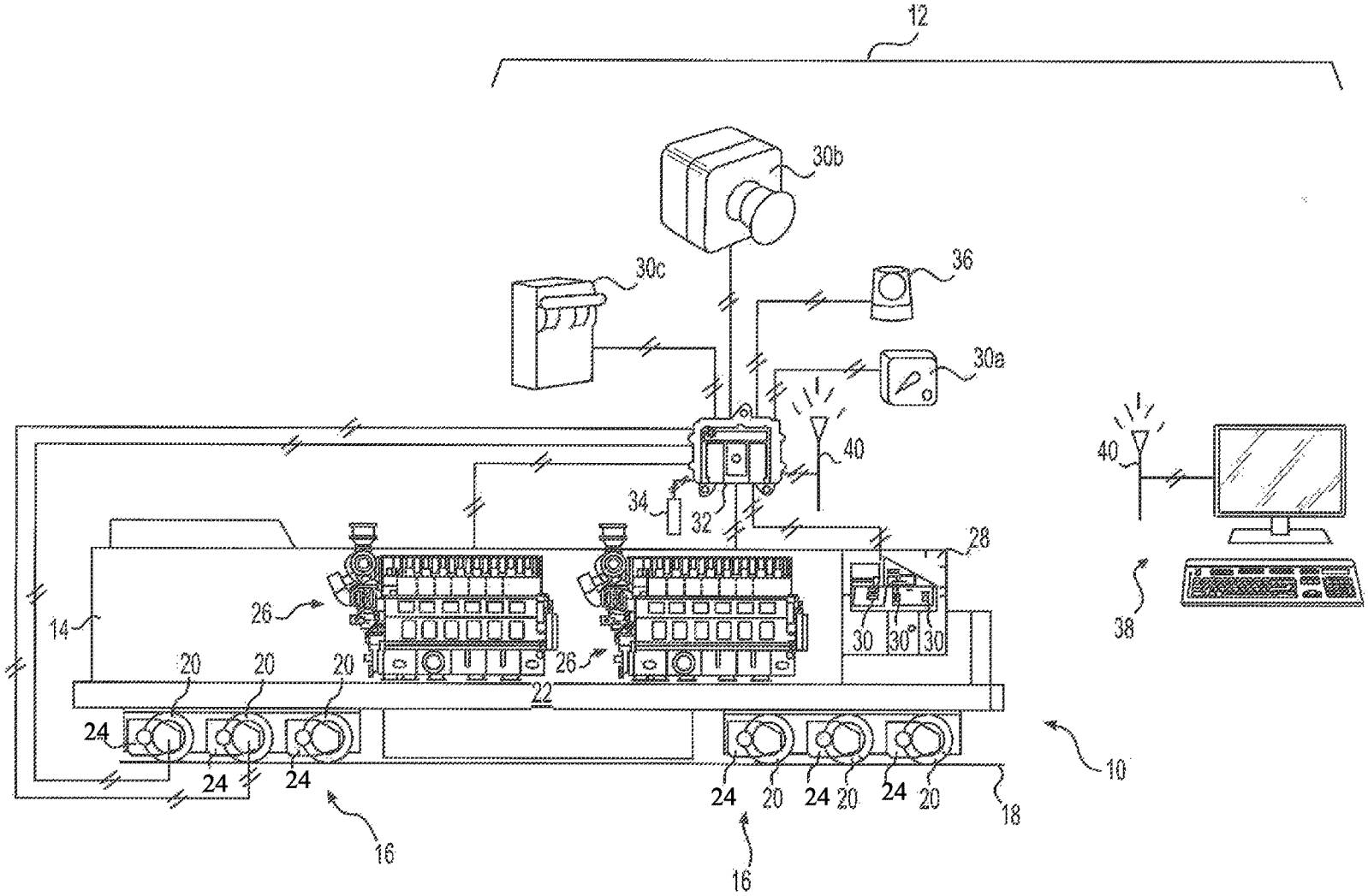
12
30b
36
30a
40
30c
32
34
28
30
30'
30"
26
22
10
18
20
24
16
14
38

SYSTEM FOR REMOTELY OVERRIDING LOCOMOTIVE CONTROLS

TECHNICAL FIELD

The present disclosure relates generally to a locomotive control system and, more particularly, to a system for remotely overriding controls of a locomotive.

BACKGROUND

Large mobile machines, for example locomotives, can operate in many different applications and many different climates. For example locomotives can operate in conditions of extreme temperature. When operating in certain conditions, if the locomotive is shut down for an extended period of time, it may be difficult to restart and/or components of the locomotive could fail. For example, if a locomotive is shut down in extremely cold conditions for an extended period of time, an engine of the locomotive may not restart easily and/or components of the engine could crack when fluids inside the engine freeze. When this happens, the locomotive can become stranded away from assistance.

One attempt to improve locomotive operation in cold extremes is disclosed in U.S. Pat. No. 2,914,644 of Hillig that issued on Dec. 1, 1959 ("the '644 patent"). In particular, the '644 patent discloses a system that can be used to remotely start the diesel engine of a locomotive when fluid temperatures inside the engine fall below a threshold temperature. The system includes a wayside station, at which the locomotive is pared, and wires connected to the locomotive that extend from the wayside station to a remote office. When a water temperature of the engine drops, a contact is closed that energizes a cold relay causing an indicator and a buzzer to sound in the remote office. At the same time, another contact is closed that causes a fuel pump of the engine and a starter motor to actuate. During and after startup, telephone lines are energized and used by personnel at the remote office to listen to the startup process and to the engine after startup to confirm successful operation of the engine. When the water temperature of the engine rises above the threshold temperature, the fuel pump is deactivated to shut down the engine.

Although perhaps somewhat successful in maintaining a desired engine temperature of a remote locomotive, the system of the '644 patent may be limited. In particular, there may be times when the locomotive is shutdown away from the wayside station, and temperatures should still be maintained in these situations. Further, there may be reasons why the engine was originally shutdown or reasons why the engine should not be restarted, and the '644 patent does not provide a way to communicate these reasons from the wayside station to the remote office. Further, the engine of the '644 patent must be specially prepared at the wayside station for remote startup (e.g., connected to the wires that extend to the office) or remote startup may not be possible. Finally, it may be possible for startup of the engine to initiate without sufficient warning onboard the locomotive, creating a potentially hazardous situation.

The present disclosure is directed at overcoming one or more of the shortcomings set forth above and/or other problems of the prior art.

SUMMARY

In one aspect, the present disclosure is directed to a control system for a machine. The control system may include a component located onboard the machine, the component having a first state and a second state. The control system may also include an operator input device located onboard the machine and used to manually toggle operation of the component between the first and second states, and at least one sensor located onboard the machine and configured to generate a signal associated with a condition of the machine. The control system may also include an offboard controller located remotely from the machine and being configured to selectively override the operator input device and toggle operation of the component between the first and second states based on the signal.

In another aspect, the present disclosure is directed to another control system for a locomotive. This control system may include an engine located onboard the locomotive, and a switch located onboard the locomotive and manually moveable between a run state allowing startup of the engine from onboard the locomotive, and an isolation state inhibiting startup of the engine from onboard the locomotive. The control system may also include a temperature sensor configured to generate a signal associated with a coolant temperature of the engine, a warning device located onboard the locomotive, and an offboard controller located remotely from the locomotive. The offboard controller may be configured to selectively activate the warning device, override the switch, and allow startup of the engine when the coolant temperature is below a threshold temperature. The control system may further include a lockout switch located onboard the locomotive and selectively activated by an operator of the locomotive to inhibit the offboard controller from starting the engine.

In yet another aspect, the present disclosure is related to a method of controlling a machine. The method may include receiving input from onboard the machine regarding an operator desire to toggle operation of a component between first and second states, and sensing a condition of the machine and generating a corresponding signal. The method may also include generating a command from offboard the machine to selectively override the input and toggling operation of the component between the first and second states based on the signal.

BRIEF DESCRIPTION OF THE DRAWING

FIG. 1 is an isometric illustration of a locomotive equipped with an exemplary disclosed control system.

DETAILED DESCRIPTION

FIG. 1 illustrates a mobile machine 10 equipped with an exemplary control system 12. In the disclosed example, machine 10 is a locomotive. However, it is contemplated that machine 10 may embody another type of machine, if desired. For example, machine 10 may embody an on- or off-highway haul truck, a construction machine, a vocational machine, or another type of machine. Alternatively, machine 10 could be a stationary machine, such as a genset, a pump, or a drill that requires continuous attention from an operator. Other types of machines may also be possible.

As a locomotive, machine 10 may include a car body 14 supported at opposing ends by a plurality of trucks 16 (only two trucks 16 shown). Each truck 16 may be configured to engage a track 18 via a plurality of wheels 20, and to support a frame 22 of car body 14. One or more traction motors 24 may be associated with one or all wheels 20 of a particular truck 16, and any number of engines 26 may be mounted to frame 22 within car body 14 and drivingly connected to produce power that drives motors 24 to propel wheels 20. Control over engine operation (e.g., starting, stopping, fueling, etc.) and traction motor operation, as well as other locomotive controls, may be provided by way of a cabin 28 supported by frame 22.

Cabin 28 may house a plurality of input devices 30 input devices 30 may be used by the operator to control machine 10 and embody any type of device known in the art. For example, input devices 30 may include, among other things, a run/isolation device (device) 30*a*, a lockout device (device) 30*b*, and any number of breakers 30*c*. Input devices 30 may be switches, levers, pedals, wheels, knobs, push-pull devices, touch screen displays, etc.

In the disclosed embodiment, operation of engine(s) 26 may be at least partially controlled by device 30*a*. In particular, device 30*a* may embody a switch that is manually movable between a run or activated state (shown in FIG. 1) and an isolation or deactivated state by an operator of machine 10. When device 30*a* is in the run state, engine(s) 26 may be allowed to start in response to a command generated from onboard machine 10. When device 30*a* is in the isolation state, engine(s) 26 may be shutdown (i.e., turned off) and not allowed to restart. In one embodiment, toggling device 30*a* to the run state causes startup of engine(s) 26 and, likewise, toggling device 30*a* to the isolation state causes engine(s) 26 to shut down. In another embodiment, toggling device 30*a* to the run state simply allows subsequent startup of engine(s) 26 using other input devices 30, and device 30*a* is only toggled to the isolation state after engine shutdown to inhibit restart of engine(s) 26. In either scenario, engine(s) 26 may not be restarted from onboard machine 10 while device 30*a* is in the isolation state. The operator of machine 10 may move device 30*a* to the run state at the start of a work shift or trip, and move device 30*a* to the isolation position at the end of the work shift or trip.

Operation of engine(s) 26 (and many other, if not all, of the functions of machine 10) may be at least partially controlled by device 30*b*. In particular, device 30*b* may embody a button or switch that is manually movable between an off position and an on position by a service technician of machine 10. When device 30*b* in the on position, all engine and machine functions may be available to the operator. When device 30*b* is in the off position, engine (and most machine) functions may not be available to the operator. The service technician may use device 30*b* during servicing, to ensure that unexpected and/or unauthorized use of engine(s) 26 and/or other machine components is not possible while the technician is in close contact with normally moving and/or energized equipment.

Breakers 30*c* may each be associated with a particular component of machine 10, and configured to trip when performance parameters associated with the component deviate from expected ranges. For example, a breaker 30*c* may be associated with power directed to individual traction motors 24, power directed to an HVAC component, power directed to lighting, etc. In this example, when a power draw greater than an expected draw occurs, breaker 30*c* may trip to interrupt the corresponding circuit. After a particular breaker 30*c* trips, the associated component may be disconnected from circuit of machine 10 and remain nonfunctional until the corresponding breaker 30*c* is reset. Breakers 30*c* may be manually tripped or reset and, in some applications, include actuators that can be selectively energized to autonomously or remotely toggle the state of the associated breakers 30*c* in response to a corresponding command.

As also shown in FIG. 1, control system 12 may further include an onboard controller (OC) 32 that is in communication with traction motors 24, engines 26, and input devices 30, and also with one or more sensors 34, a warning device 36, and an offboard worksite controller (OWC) 38 via a communications device 40. OC 32 may embody a single or multiple microprocessors, field programmable gate arrays (FPGAs), digital signal processors (DSPs), etc., that include a means for controlling operations of machine 10 in response to operator requests, built-in constraints, sensed operational parameters, and/or communicated instructions from OWC 38. Numerous commercially available microprocessors can be configured to perform the functions of these components. Various known circuits may be associated with these components, including power supply circuitry, signal-conditioning circuitry, actuator driver circuitry (i.e., circuitry powering solenoids, motors, or piezo actuators), and communication circuitry.

Machine 10, including engine(s) 26, may be outfitted with any number and type of sensors 34 known in the art for generating signals indicative of associated performance parameters. In one example, machine 10 includes a temperature sensor 34 configured to generate a signal indicative of a coolant temperature of engine(s) 26. Additionally or alternatively, sensors 34 may include a brake temperature sensor; an exhaust sensor; a fuel level, pressure, and/or temperature sensor; a boost temperature or pressure sensor; a knock sensor; a reductant level and/or temperature sensor; an oil level, pressure, and/or temperature sensor; a speed sensor; or any other sensor known in the art. The signals generated by sensor(s) 34 may be directed to OC 32 for further processing.

Any number and type of warning devices 36 may be located onboard machine 10, including an audible warning device and/or a visual warning device. Warning device 36 may be used to alert an operator of machine 10 of an impending operation, for example startup of engine(s) 26. Warning device 36 may be triggered manually from onboard machine 10 (e.g., in response to movement of device 30*a* to the run state and/or 30*b* to the on position) and/or remotely from offboard machine 10. When triggered from offboard machine 10, a corresponding command signal used to initiate operation of warning device 36 may be communicated to OC 32 via communications device 40.

OWC 38 may include any means for monitoring, recording, storing, indexing, processing, and/or communicating various operational aspects of machine 10. These means may include components such as, for example, a memory, one or more data storage devices, a central processing unit, or any other components that may be used to run an application. Furthermore, although aspects of the present disclosure may be described generally as being stored in memory, one skilled in the art will appreciate that these aspects can be stored on or read from different types of computer program products or computer-readable media such as computer chips and secondary storage devices, including hard disks, floppy disks, optical media, CD-ROM, or other forms of RAM or ROM.

OWC 38 may be configured to execute instructions stored on computer readable medium to perform methods of remote control of machine 10. That is, as will be described in more detail in the following section, onboard control (manual and/or autonomous control) of some operations of machine 10 (e.g., operations of traction motors 24, engine(s) 26, breakers 30*c*, etc.) may be selectively overridden by OWC 38. For example, OWC 38 may be configured to selectively override device 30*a* and cause startup of engine(s) 26, even when device 30*a* is in the isolation position. Similarly, particular traction motors 24 may be selectively turned on/off remotely, and/or breakers 30*c* may be reset or tripped remotely.

Remote control of machine 10 between OC 32 and OWC 38 may be facilitated via communications device 40. Communications device 40 may include hardware and/or software that enables sending and receiving of data messages between 32 and OWC 38. The data messages may be sent and received via a direct data link and/or a wireless communication link, as desired. The direct data link may include an Ethernet connection, a connected area network (CAN), or another data link known in the art. The wireless communications may include satellite, cellular, infrared, and any other type of wireless communications that enable communications device 40 to exchange information between OWC 38 and the components of OC 32.

Based on information from input devices 30 and sensor(s) 34, and based on instructions from OWC 38, OC 32 may be configured to help regulate movements and/or operations of its associated machine 10 (e.g., direct operations of associated traction motors 24, engines 26, breakers 30*c*, etc.). OC 32 may be configured to autonomously control these movements and operations, OC 32 may also be configured to send operational information associated with components of machine 10 offboard to OWC 38 via communications device 40, if desired. This information may include, for example, parameters associated with signals generated by sensor(s) 34, positions of devices 30*a* and 30*b*, a state of engine(s) 26, conditions of traction motors 24, and other information known in the art. The information may then be displaced at a remote facility housing OWC 38 for use by a remote user in determining operational commands for machine 10.

INDUSTRIAL APPLICABILITY

The control system of the present disclosure may be applicable to any machine where remote access to particular functions of the machine may be desirable. These functions may normally be controlled manually from onboard the machine, and remote access to these functions may provide a way to inhibit machine damage and/or reduce the likelihood of the machine from becoming stranded when human operators are not present or available within the machine. Operation of control system 12 will now be described in detail.

During normal operation, a human operator may be located onboard machine 10 and within cabin 28. The human operator may be able to control when engine(s) 26 are started or shut down, which traction motors 24 are used to propel machine 10, and when and what breakers 30*c* should be reset or tripped. However, there may be times when the human operator is not available to perform these functions, when the human operator is not onboard machine 10, and/or when the human operator is not sufficiently trained or alert to perform these functions.

For example, a particular machine 10 may be parked at a remote location for an extended period of time, without an operator. And during extreme conditions, for example during cold ambient conditions, machine 10 may begin to acclimate to the surroundings. In this situation, if machine 10 (particularly engines 26) were to cool down too much, engines 26 may be difficult to restart and/or fluids within machine 10 could freeze. For example coolant within of engines 26 could freeze, causing components (e.g., the blocks or pumps) of engines 26 to crack and ail, if an operator were onboard and monitoring conditions of engines 26, the operator could periodically restart engines 26 before engines 26 cooled too much, and allow engines 26 to warm up to temperatures at which freezing would not be possible. However, in applications where the operator is not present, this may not be possible.

When machine 10 is parked for an extended period of time, part of the normal engine shutdown routine may include moving device 30*a* to the isolation state. From this point on, startup of engines 26 may not be possible from onboard machine 10. In the disclosed embodiment, however, OWC 38 may be capable of selectively overriding device 30*a* and initiating a startup procedure regardless of the position of device 30*a*.

The overriding of device 30*a* and initiation of the engine startup procedure may be implemented manually or automatically from the remote facility. For example, signals from sensor(s) 34 may be communicated offboard machine 10 via OC 32 and communications device 40 to OWC 38, even when machine 10 is parked and engines 26 are shutdown. These signals may be displayed to a user (e.g., to office personnel) at the remote facility, and the user may responsively provide input to OWC 38 regarding a desire to initiate startup of engines 26. This input may be received via an input device (e.g., a keyboard or mouse) connected to or integrally forming a part of OWC 38, and OWC 38 may generate corresponding command signals directed to OC 32 via communications device 40. In an alternative embodiment, OWC 38 may automatically implement startup of engines 26 without input from the remote user in response to the monitored parameter deviating from an expected range (e.g., in response to coolant temperatures falling below a threshold temperature).

After determining that engines 26 should be started and prior to issuing the command for engine startup, OWC 38 may first generate a warning that engines 26 are about to be started. For example, a command may be generated and directed to warning device 36 via communications device 40 and OC 32, causing warning device 36 to visually and/or audibly alert any nearby personnel that engines 26 may soon be started. This warning may be provided sufficiently in advance of initiating engine startup to allow an operator of machine 10 to activate device 30*b* and thereby abort the startup sequence, if desired, and/or to make the environment ready for startup (e.g., to move personnel and equipment to a location away from engines 26).

In some embodiments, remote startup of engines 26 may be inhibited without the use of device 30*b*, if desired. For example, particular conditions onboard machine 10 that caused the original shutdown of engines 26 may also inhibit restart of engines 26. For example, conditions occurring that could cause damage to engines 26 upon restart may be observed by OC 32 and/or OWC 38 (e.g., via sensors 34) and used as a basis to inhibit startup. These conditions could include, for example, excessively high engine temperatures, low lubricating fluid levels, etc. Normal startup routines that check for these conditions may block local and remote attempts to restart engines 26.

The operation of traction motors 24 and/or breakers 30*c* may be remotely controlled in a similar manner. Specifically, conditions associated with operation of these components (e.g., conditions detected via sensors 34) may be monitored via OWC 38 and/or a remote operator, and corresponding commands may be generated to selectively change the state of breakers 30*c* (e.g., trip or reset breakers 30*c*) or traction motors 24 (e.g., to cut in or cut out particular traction motors 24) based on the conditions. In these situations, onboard settings that are manually controlled by the operator of machine 10 may need to be overridden in order for the states (e.g., activated and deactivated states) of traction motors 24 and/or breakers 30*c* to be remotely toggled.

Because control system 12 may allow for remote overriding of onboard manual control settings, operation of machine 12 may be simplified. In particular, machine 12 may not need to first be prepared for remote control functionality, allowing for greater protection in unexpected situations and at unexpected locations. In addition, because the disclosed system may provide a warning prior to assuming remote control of machine 12, operation of machine 12 may be secure.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein it is intended that the specification and examples be considered as exemplary only, with a true scope of the disclosure being indicated by the following claims and their equivalents.

What is claimed is:

1. A control system for a machine, comprising:

a component located onboard the machine and having a first state and a second state;

an operator input device located onboard the machine and used to manually toggle operation of the component between the first and second states;

at least one sensor located onboard the machine and configured to generate a signal associated with a condition of the machine;

an offboard controller located remotely from the machine and being configured to selectively override the operator input device and toggle operation of the component between the first and second states based on the signal, wherein the component is an engine, the at least one sensor is a temperature sensor configured to generate a signal indicative of a coolant temperature of the engine, and the operator input device is a first operator input device;

a display associated with the offboard controller and configured to receive the signal and display a representation of the coolant temperature; and a second operator input device associated with the offboard controller and the display, the offboard controller is further configured to receive a command from the second operator input device indicative of a desire to override the first operator input device and cause startup of the component.

2. The control system of claim 1, further including an onboard controller connected with the component, the first operator input device, and the at least one sensor is in wireless communication with the offboard controller.

3. The control system of claim 1, wherein the first and second states include an activated state and a deactivated state, respectively.

4. The control system of claim 1, wherein:

the first operator input device is a switch moveable from a run position that allows startup of the engine from onboard the machine, to an isolation position that inhibits startup of the engine from onboard the machine; and the offboard controller is configured to selectively cause startup of the engine regardless of a position of the switch.

5. The control system of claim 1, wherein the offboard controller is configured to automatically cause startup of the engine based on the coolant temperature being less than a threshold temperature.

6. The control system of claim 1, further including a warning device located onboard the machine, wherein the offboard controller is configured to selectively activate the warning device before overriding the first operator input device and toggling operation of the component.

7. The control system of claim 1, further including a lockout switch selectively activated by an operator of the machine to inhibit the offboard controller from remotely toggling operation of the component.

8. A control system for a locomotive, comprising:

an engine located onboard the locomotive;

a switch located onboard the locomotive and manually moveable between a run state allowing startup of the engine from onboard the locomotive, and an isolation state inhibiting startup of the engine from onboard the locomotive;

a temperature sensor configured to generate a signal associated with a coolant temperature of the engine;

a warning device located onboard the locomotive;

an offboard controller located remotely from the locomotive and being configured to selectively activate the warning device, override the switch, and allow startup of the engine when the coolant temperature is below a threshold temperature; and a lockout switch located onboard the locomotive and selectively activated by an operator of the locomotive to inhibit the offboard controller from starting the engine.

* * * * *